US005085476A

United States Patent [19]

Fuehrer

[11] Patent Number: 5,085,476

[45] Date of Patent: Feb. 4, 1992

[54] DRUM RING SEAL

[75] Inventor: Charles Fuehrer, Scardsdale, N.Y.

[73] Assignee: Stoffel Seals Corporation, Tuckahoe, N.Y.

[21] Appl. No.: 682,524

[22] Filed: Apr. 9, 1991

[51] Int. Cl.[5] ..... E05C 19/18

[52] U.S. Cl. ..... 292/307 R; 292/256.69; 292/318

[58] Field of Search ..... 292/307 R-323, 292/256.69

[56] References Cited

U.S. PATENT DOCUMENTS

| | | | |
|---|---|---|---|
| Re. 31,706 | 10/1984 | Neto . | |
| 2,966,378 | 12/1960 | Carpenter et al. | 292/256.69 |
| 3,556,575 | 1/1971 | Farkas | 292/318 |
| 3,708,835 | 1/1973 | Brenz | 292/307 R |
| 3,768,848 | 10/1973 | Santoni | 292/256.69 |
| 3,814,298 | 6/1974 | Hansen . | |
| 4,106,801 | 8/1978 | Neto . | |
| 4,197,982 | 4/1980 | Netto . | |
| 4,676,084 | 6/1987 | Signorelli . | |
| 4,699,408 | 10/1987 | Kesselman | 292/307 R |
| 4,743,641 | 12/1988 | Sokol | 292/322 |
| 4,883,295 | 11/1989 | Kesselman | 292/307 R |

FOREIGN PATENT DOCUMENTS

| | | | |
|---|---|---|---|
| 18249 | 1/1954 | Fed. Rep. of Germany | 292/319 |
| 2482177 | 11/1981 | France | 292/307 R |

*Primary Examiner*—Eric K. Nicholson
*Attorney, Agent, or Firm*—Dowell & Dowell

[57] ABSTRACT

A seal for a projecting drum ring includes a housing which is open at the back and the bottom and has a stem with a tapered head extending downwardly, the stem being connected by a relatively weak joint to the upper wall of the housing, the upper wall having a strap extending therefrom in order that when the tapered head is pressed through the ring it is retained against undetected tampering but the seal may be easily removed by pulling on the strap thereby breaking the stem at the connection to the head.

4 Claims, 2 Drawing Sheets

DRUM RING SEAL

BACKGROUND OF THE INVENTION

1. Field of the Invention

This invention relates to security seals of the type that are connected to a ring member in order to prevent unauthorized withdrawal of the ring from its connecting elements, which is relatively inexpensive and easily removed by authorized personnel. The structure of the ring is such that any unauthorized removal or tampering is readily apparent.

2. Description of the Related Art

The U.S. patent to Signorelli U.S. Pat. No. 4,676,084, discloses a cap for protecting the open end of a lock. The cap has a stem or arrow which extends through the opening into a retainer. The stem may be weakened in order to facilitate its removal from the lock.

The U.S. patent to Hansen U.S. Pat. No. 3,814,298, and patnts to Neto U.S. Pat. Nos. 4,106,801, 4,197,982 and Re. 31,706, disclose seals having enlarged flexible heads simulating arrows which have weakened portions to facilitate breakage.

SUMMARY OF THE INVENTION

It is an object of the invention to provide a one piece or unitary seal for a ring member which projects from a retaining element or wall and which both interlocks with the ring member and covers the interlocking parts in order to protect against tampering.

A further object of the invention is the provision of a covering and locking seal for a ring member which is protected against tampering and which is relatively easy to remove and inexpensive.

A further object of the invention is the provision of a covering security seal which is easily attached and removed and which uses an engaged wall of the protected structure as a barrier to tampering with the seal.

These and other objects of the invention will becomes apparent from the following description in conjunction with the accompanying drawings in which.

DESCRIPTION OF THE PREFERRED EMBODIMENT

Figure 1:
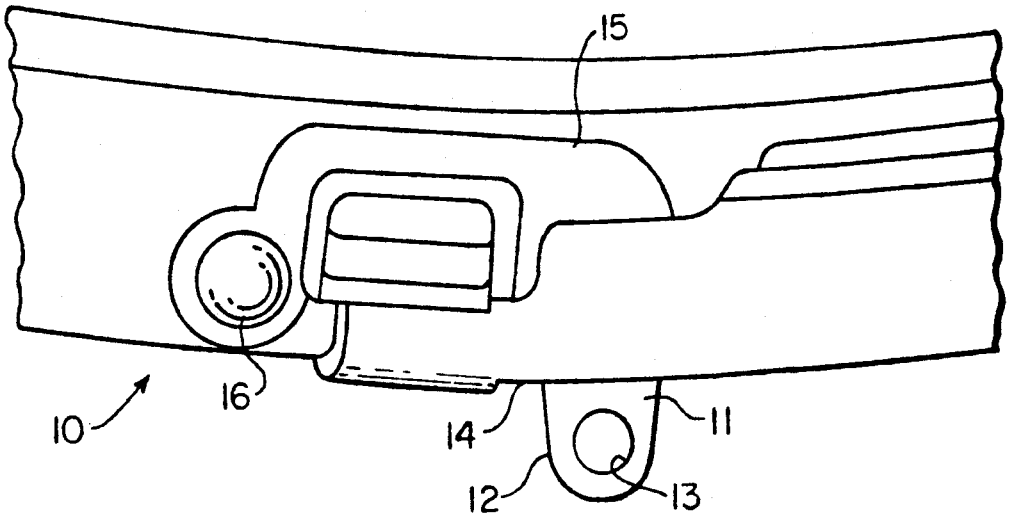
FIG. 1 is an enlarged plan view of a typical fiber drum seal of the type that is protected by an embodiment of the present invention.
Figure 2:
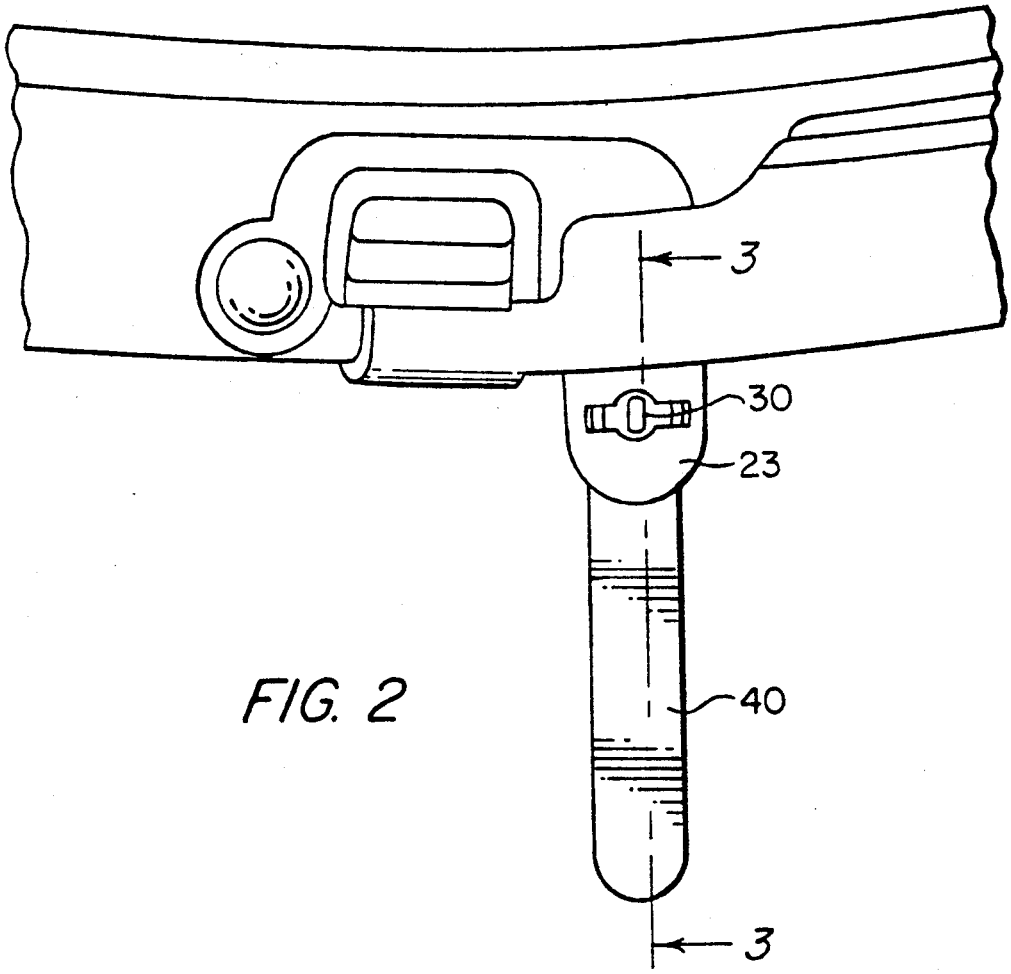
FIG. 2 is an enlarged plan view showing a seal in accordance with the present invention mounted on the exposed ring of the fiber drum.

A conventional fiber drum is indicated at 10 having a ring member 11 with an outer periphery 12 and an opening 13 extending from a hasp at the face 14 of the locking assembly. The ring member is connected by an arm 15 to a hinge 16 by means of which the arm and ring member 11 may be retracted.

In order to prevent unauthorized retraction of the ring member 11 and opening of the drum a seal in accordance with the present invention is provided to engage the exposed ring member 11. The seal includes a housing 20 which may be generally concave providing a rear wall 21, side walls 22 and a top wall 23. The rearward edges 25 of the side walls are preferably inclined as illustrated thereby reducing the size of the bottom opening 26 through which a tampering instrument can be inserted when the seal is mounted on the ring.

The seal has a stem 30 extending from top wall 23 and with an enlarged portion forming front and rear abutments 31 and 32 of a size to be received rather closely within the ring opening 13 of the ring 11. The narrower portion of the stem below the abutments 31 and 32 extends to a flexible tapered head portion 34 which is of a size and nature to be inserted within the ring and then expanded to prevent withdrawal therefrom. The head portion is generally arrow shaped, having a tip 35 and diverging arms 36 which terminate in spaced relation from the top wall 23 in order to permit ring member 11 to seat on the stem around abutments 31 and 32. The stem abutments 31 and 32 are connected by weakened portions 37 and 38 to the top wall 23. The top wall 23 has a transverse slot 39 which receives the upper portion of the stem 30 and provides for the weakening connections at 37 and 38. Extending from the top wall 23 of the seal is a strap 40 which may be of any desired length.

Figure 3:
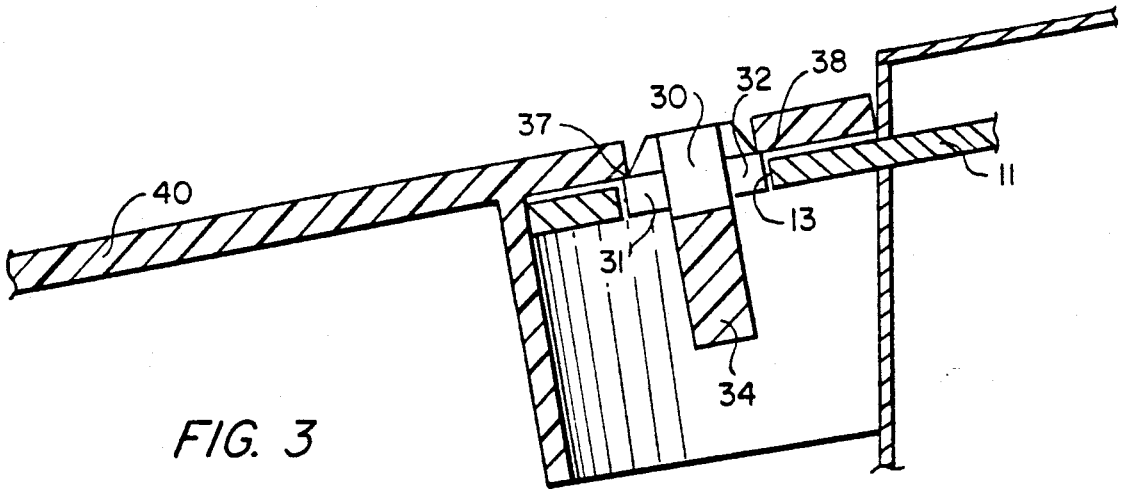
FIG. 3 is a section to an enlarged scale on the line 3—3 of FIG. 2.
Figure 4:
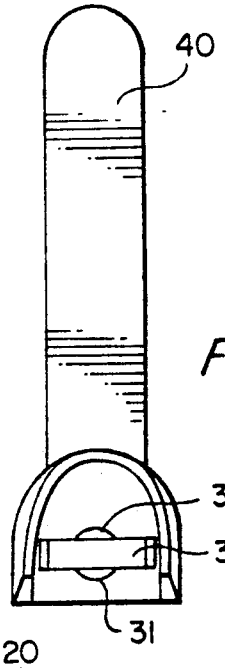
FIG. 4 is a further enlarged portion bottom plan view of the seal.
Figure 5:
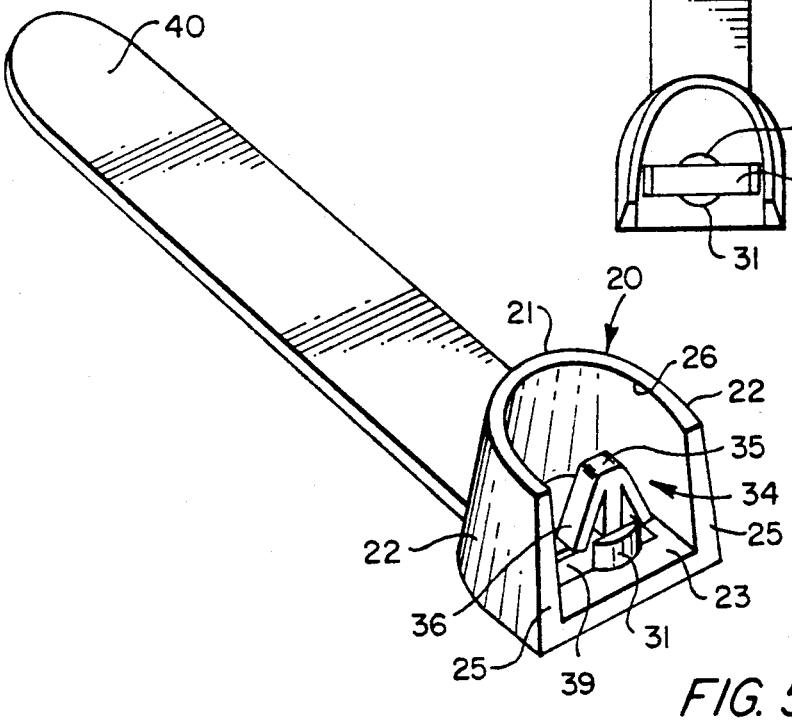
FIG. 5 is a further enlarged perspective of the seal.

In the use of the seal, it is placed over the ring member 11 and with the thumb or other finger may be pressed down so that the flexible head portion 34 enters the opening 13 in the ring until the seal seats into the position indicated in FIG. 3. In this position the seal may not be easily tampered with nor removed except by pulling forcibly on a strap 40 which causes the stem to break away at the weakened points 37 and 38 and thus permitting removal of the seal from the ring.

I claim:

1. A seal for use with a drum lug ring which projects from a retaining element, said lug ring having an outer periphery and an opening, comprising a housing having top and bottom means, and wall means extending from the top to the bottom means, said wall means including a continuous wall along the sides and a front end of said housing, said wall means leaving open a back end of said housing, said bottom means being open, the housing being of a size to enclose closely the outer periphery of the lug ring when the back end of the housing is positioned against the element from which the lug ring extends, said top means having a stem extending downwardly therefrom within the housing and of a size to be received in said opening and a flexible tapered head portion extending from said stem and having a lower end adapted to enter said opening, said head portion inclined upwardly and outwardly from said lower end, said tapered head portion terminating in spaced relation below said top means, said tapered head portion being compressible to enter said ring opening and to re-expand to prevent withdrawal of said head portion through said opening when said stem is received in said opening, and strap means extending outwardly from said top means, said stem being connected to said top means by a portion of reduced thickness, whereby said seal may be separated from said ring by pulling said strap means to cause said stem to separate from said top means at the portion of reduced thickness.

2. The invention of claim 1, in which said tapered head portion comprises flexible arm means extending from the outer end of said stem.

3. The invention of claim 1, in which said top wall means has a lateral slot substantially centrally thereof, and said stem is connected to said top wall means at the sides of said slot.

4. The invention of claim 1, in which said side wall means tapers from said top wall means forwardly and downwardly whereby the bottom of said housing is smaller than its top wall means, thus reducing the bottom access opening into said housing.

* * * * *